US005573132A

United States Patent [19]

Kanfer et al.

[11] Patent Number: 5,573,132

[45] Date of Patent: Nov. 12, 1996

[54] DISPENSING CONTAINER

[76] Inventors: Joseph S. Kanfer, 2825 N. Walnut Ridge, Akron, Ohio 44313; Ronald F. Bell, 13040 Oakwood Ave., NW., Uniontown, Ohio 44685; Rodney D. Borst, Oregon, Wis. 53575; Thomas Kearnes, 3750 W. Streetsboro Rd., Richfield, Ohio 44286; Gregg S. Lewis, 1701 Henry St., Middleton, Wis. 53562

[21] Appl. No.: 345,870

[22] Filed: Nov. 25, 1994

[51] Int. Cl.[6] ..... B65D 43/00

[52] U.S. Cl. ..... 220/4.23; 220/254

[58] Field of Search ..... 220/4.23, 254, 220/256, 339, 610, 625; 206/503, 508

[56] References Cited

U.S. PATENT DOCUMENTS

| | | | |
|---|---|---|---|
| 4,739,900 | 4/1988 | Borst | 220/339 |
| 4,928,839 | 5/1990 | Kruelskie | 206/508 |
| 4,986,438 | 1/1991 | Borst | 220/315 |
| 5,040,680 | 8/1991 | Wilson et al. | 206/459 |
| 5,042,659 | 8/1991 | Morita | 220/339 X |
| 5,131,551 | 7/1992 | Wells | 220/4.23 |
| 5,184,720 | 2/1993 | Packer et al. | 220/4.01 X |

*Primary Examiner*—Steven M. Pollard
*Attorney, Agent, or Firm*—Reese Taylor

[57] ABSTRACT

A reclosable container for storing and dispensing articles includes a body with a hinged base which can be opened for insertion of a supply of the articles and a cover, hinged to the body for access to the stored articles. The body and both the base and the cover have complementally configured locking projections and depressions so that they may be locked together in the closed position to seal off the interior. The cover also has a complemental configuration to the peripheral configuration surrounding an opening in the body to provide interlocking and surface to surface contact therebetween to further insure a substantially airtight seal therebetween. Also the top of the body, including the cover, and the base are of a complemental concave/convex configuration on to facilitate nesting of multiple containers.

12 Claims, 4 Drawing Sheets

DISPENSING CONTAINER

BACKGROUND OF THE INVENTION

This invention relates in general to a dispensing container and relates in particular to a dispensing container having particular utility to the dispensing of pre-moistened towelettes.

DESCRIPTION OF THE PRIOR ART

Reclosable dispensers are known in the dispensing art and particularly known are dispensing containers which are designed to receive refills or packages of the articles being dispensed so that the dispensing container itself is a more or less permanent article, while the supplies contained therein can be readily replenished from time to time.

This particular invention is designed for the dispensing of pre-moistened towelettes, but could well have utility for the dispensing of other articles. However, in dispensing pre-moistened towelettes of the type wherein soap or other cleansing or soothing materials are impregnated into the towelettes, in addition to the desirability for ease of access to the contents and ease of access to the interior for replacement purposes, it is important to maintain a relatively tight seal during periods of non-use so as to prevent the drying out of the articles being dispensed.

In general, dispensing containers having a suitable access to the contents and to the interior as well as locking means for the cover and base can be seen in Borst U.S. Pat. No. 4,739,900; Borst U.S. Pat. No. 4,986,438 and Wilson U.S. Pat. No. 5,040,680.

These patents, in general, disclose flexible reclosable thermoformed thermoplastic containers including a base which is hingedly connected to the main body with the main body including sidewalls and a top wall. The top wall is provided with an access opening and a cover is hingedly connected to the main body to normally close off the access opening.

As noted, the base of this prior art is hingedly connected to the sidewalls of the main body and can be opened and closed so as to replenish the supplies contained in the interior chamber as required. Locking means are also provided to securely hold the base in the closed position.

As previously mentioned, the top wall of the prior art discloses an access opening centrally disposed therein and a hinged cover which is movable between covering and uncovering positions so as to close off this top access opening. Wilson U.S. Pat. No. 5,040,680 also discloses the inclusion of a flexible substrate 30 which serves to interconnect the cover to the main body and serve as the hinged connection therebetween while being capable of receiving indicia such as advertising or instructional material.

The patents just referred to appear to represent the most relevant prior art to the present invention, which may be considered to be an improvement thereon.

Specifically, it is believed desirable to provide for the nesting of a plurality of such containers. These containers, during shipping, handling and storage, are commonly stacked one upon the other and, therefore, it is believed desirable to enhance the stacking capabilities thereof.

Additionally, it is believed desirable to enhance the locking and sealing capabilities of such containers, particularly when used with pre-moistened towelettes wherein it is important not only to protect the contents of the container from contamination or soiling, but to maintain a substantially airtight closure to maintain the pre-moistened condition of the articles.

It is also believed desirable to provide a container which is easy to manipulate and operate by the end user, both from the standpoint of replenishing the supply of articles within the box, i.e., facilitating opening of the base, but for access to the interior of the box to actually extract the articles being dispensed, i.e., facilitating operation of the cover.

Finally, it is believed desirable to enhance the economic feasibility of such a container by modifying it to facilitate manufacture thereof.

SUMMARY OF THE INVENTION

It accordingly becomes the principal object of this invention to provide a dispensing container which permits easy access to the interior, both for replenishment and use and which has enhanced capabilities for maintaining the desired condition of the contents and which is easy to operate and economical to manufacture.

In furtherance of the principal object of the invention, it has been found that access to the interior of the box can be improved by providing gripping means on the locking tab which locks the base to the main body so as to enhance the capability of the user in accessing the interior of the container.

It has further been found, in furtherance of the principal object of the invention, that indicia bearing surfaces can be provided on the locking means for securing the base to the body, both when the locking tab is in the locked position and when it is open to thereby enhance the ease of use for the end user.

It has further been found that, in accordance with the principal object of the invention, such ease of use can be further enhanced by providing depressions for finger access beneath the locking tab to facilitate opening and disengagement of the locking tab.

In furtherance of the principal object of the invention, it has been further found that improved locking means interconnecting the cover with the top of the main body can be provided so as to provide a relatively secure and airtight seal between the cover and the body.

It has further been found, in accordance with the principal object of the invention, that operation of the cover can be enhanced by providing an overhanging lip on the front or unhinged edge of the cover and a depression or recess in the front wall of the main body adjacent the front edge of the cover so as to facilitate access to the lip for unlocking and opening purposes.

In accordance with the principal object of the invention, it has also been discovered that a central recess can be provided in the top wall of the main body with a upstanding shelf extending therefrom adjacent to the hinge point to facilitate attachment of the substrate 30 which serves as a hinge during the manufacturing operation.

It accordingly becomes the principal object of this invention to provide an improved dispensing container of the above described with other objects thereof becoming more apparent upon a reading of the following brief specification considered and interpreted in view of the accompanying drawings.

BRIEF DESCRIPTION OF THE PREFERRED EMBODIMENTS

Figure 1:
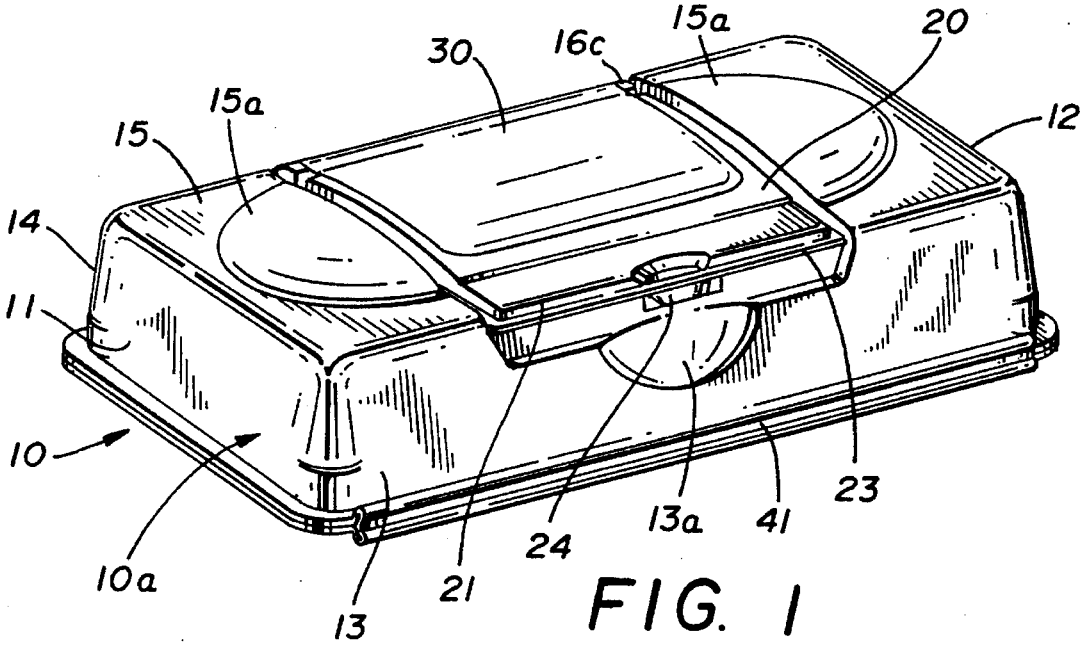
FIG. 1 is a perspective view showing the improved dispensing container showing the cover in the closed position.
Figure 2:
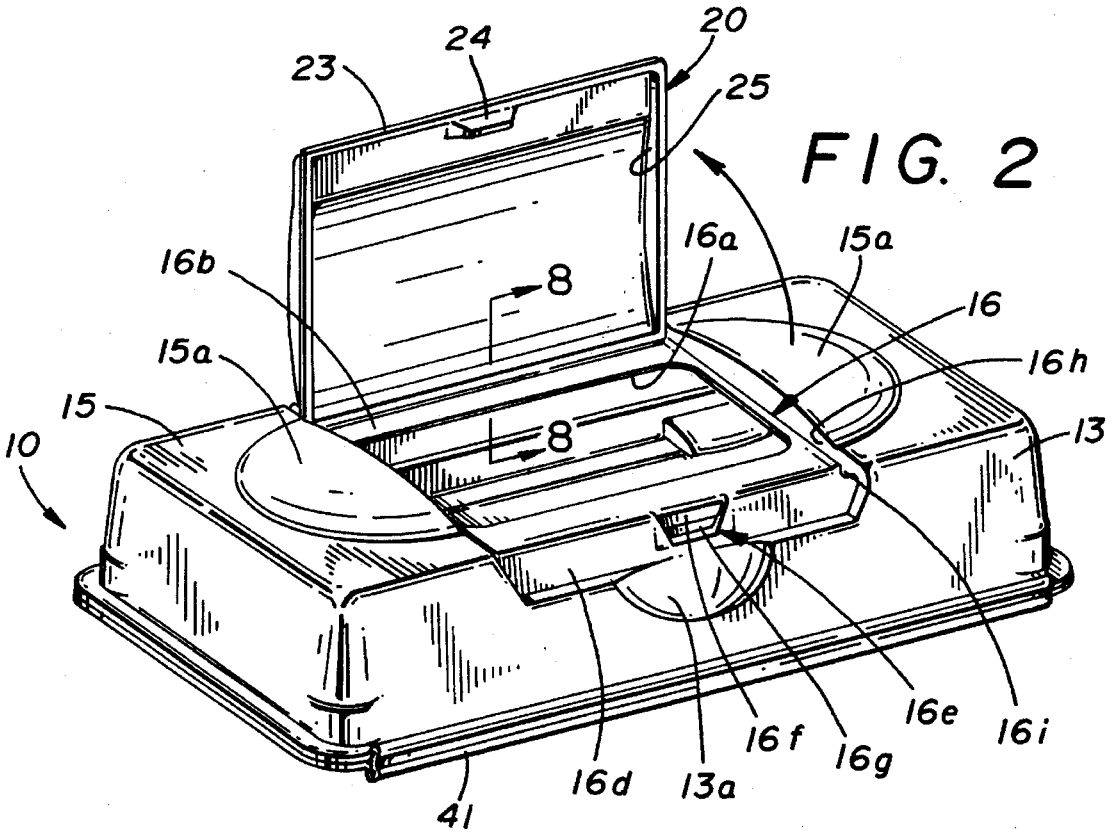
FIG. 2 is a further perspective view of the improved container showing the cover in the open position.

Referring first then to FIGS. 1 and 2 of the drawings, it will be seen that the improved dispenser, generally indicated by the numeral 10, includes a cup shaped main body 10*a* having opposed end walls 11 and 12 and front and rear walls 13 and 14 joined together with a top wall 15 to partially enclose an interior chamber.

Still referring to FIGS. 1 and 2 of the drawings, it will be noted that part of top wall 15 has a convex surface area 15*a*, 15*a* which is interrupted by a recessed area 16.

Figure 3:
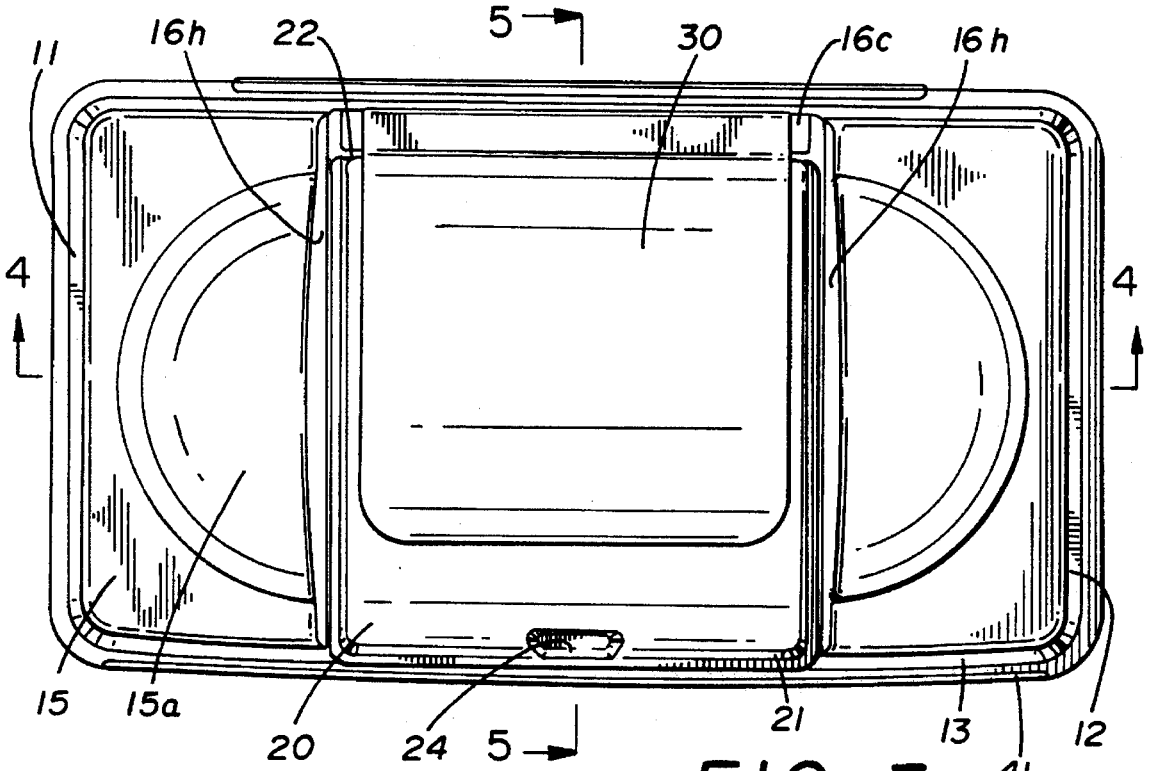
FIG. 3 is a top plan view of the improved dispenser.
Figure 4:
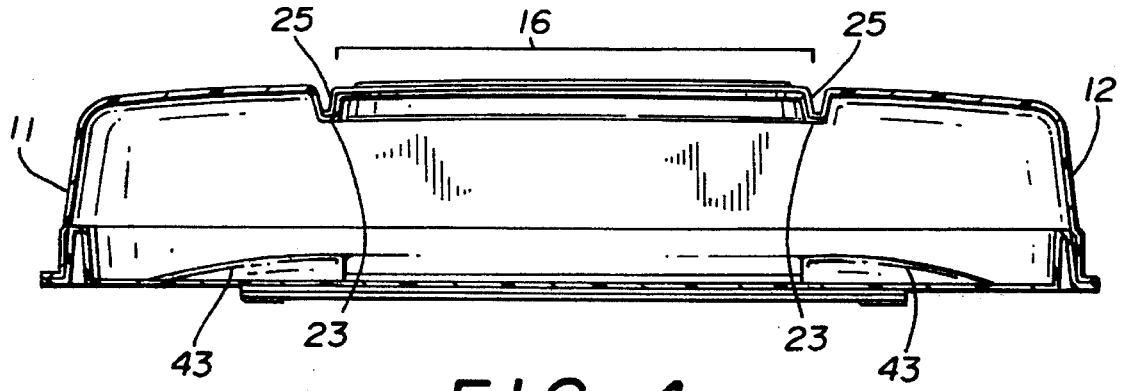
FIG. 4 is a sectional view taken along the line 4—4 of FIG. 3.

This recessed area 16 includes an access opening 16*a* and a ledge 16*b* which is recessed below the plane of the top wall 15 and surrounds the access opening 16*a*. As can be seen in FIG. 3 of the drawings, an upstanding shelf 16*c* is disposed at the rear of the dispenser and extends upwardly from the ledge 16*b* to approximately the same height as the plane of the top wall 15. This shelf 16*c* serves as one of the anchoring points for a hinge which will be described below.

Figure 8:
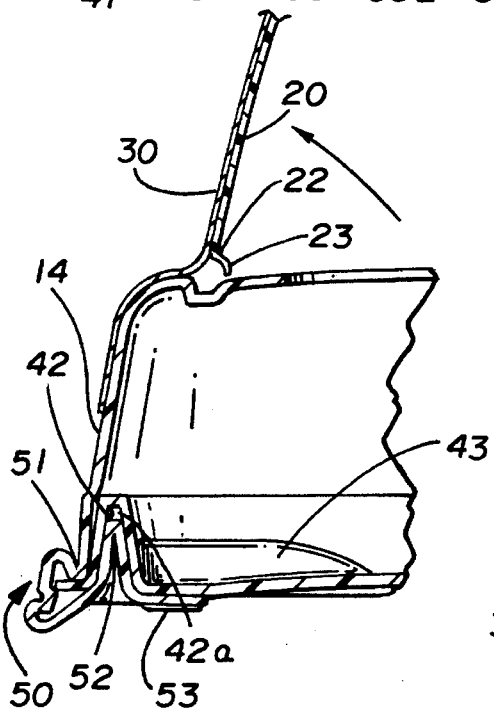
FIG. 8 is a partial sectional view of the improved dispenser taken along the line 8—8 of FIG. 2 and showing the lid in a partially open position and the locking tab closed.
Figure 9:
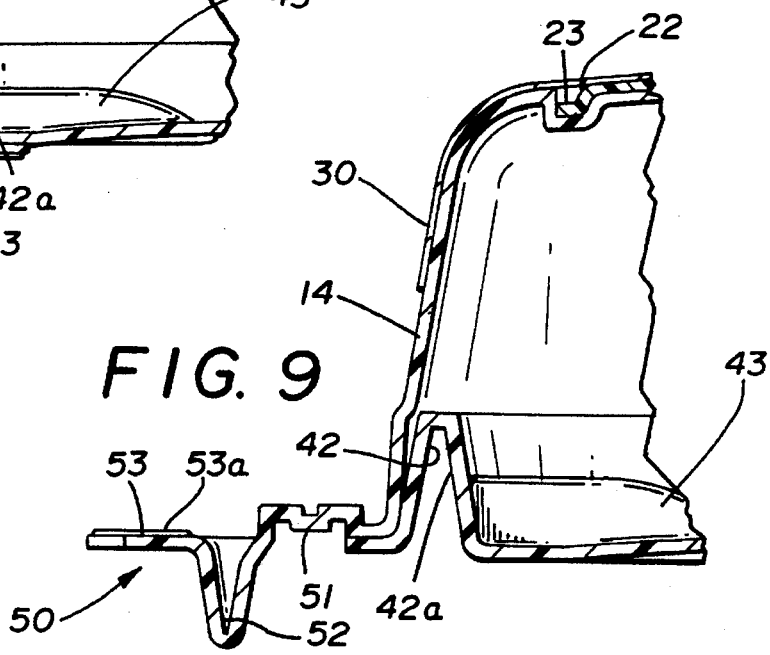
FIG. 9 is a partial enlarged view of the structure shown in FIG. 8 with the lid in the closed position and the locking tab in the open position.

A cover 20 is disposed on the main body 10*a* and is hinged thereto by a substrate 30. Cover 20 has a convex configuration so that, when closed as shown in FIG. 1, it forms a substantially uninterrupted convex surface with areas 15*a*, 15*a*. The substrate 30 attaches to the top of the cover 20, to the top of the shelf 16*c* and to the rear wall 14 of the main body 10*a*, as can be seen in FIGS. 3 and 8 of the drawings. The provision of the shelf 16*c* facilitates assembly and the presence of the substrate 30, in addition to serving as the hinge between the cover 20 and main body 10*a*, permits the application of advertising or instructional indicia thereto, whereby the substrate 30 serves a dual purpose.

The cover 20 will be noted to have from and rear edges 21 and 22 (SEE FIG. 3) and a peripheral lip 23 will be seen to extend completely around the periphery of the cover 20. Adjacent to front edge 21 of the cover 20 is a locking member 24 which essentially comprises a downwardly extending projection intended to mate with a complementally configured depression on the main body 10*a* as will be described. Suffice it to say here that this locking member 24 serves as part of the first locking means referred to herein and is used to secure the cover 20 in the closed or coveting position whereby the access opening 16*a* is adequately closed off.

Figure 5:
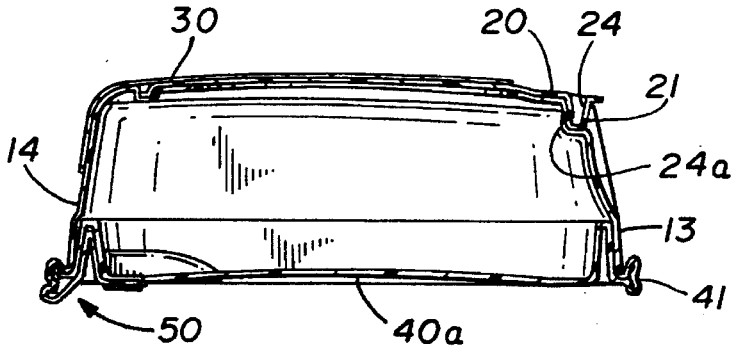
FIG. 5 is a sectional view taken along the line 5—5 of FIG. 3.
Figure 6:
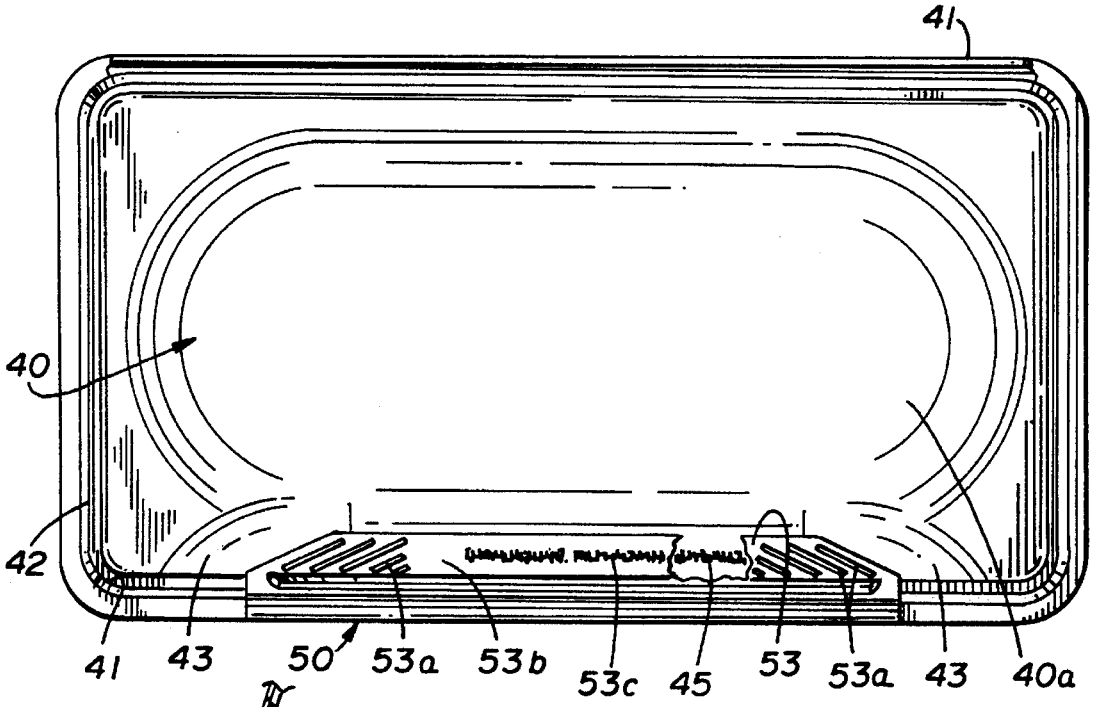
FIG. 6 is a bottom plan view of the improved dispenser.

With regard to this first locking means, it will be noted that the ledge 16*b* terminates in a downwardly extending front wall 16*d* which is recessed somewhat from the outer surface of the front wall 13 of the main body 10*a*. This wall has a recess 16e which is configured complementally to as can be seen in FIG. 2 the locking member 24 of the cover 20 for engagement therewith when it is desired to lock the cover 20 in place. In that regard, it will be noted that the recess 16*e* has a first vertical surface 16*f* and which is undercut and leads to a second vertical surface 16*g*. Similarly, it will be noted that the locking member 24 is undercut as at 24*a* (see FIG. 5) so as to permit a positive locking engagement between locking member 24 and recess 16*e*. In this fashion, secure engagement therebetween can be achieved to further facilitate the desirable sealing of the interior chamber.

Also with regard to this feature, it will be noted that the cover 20 is somewhat cup shaped and has depending walls along its sides, indicated by the numeral 25. These walls terminate in the peripheral lip 23. Similarly, the ledge 16*b* is separated from the top wall 15 of the main body 10*a* by grooves 16*h*, 16*h* which extend from front to rear of the main body 10*a*. When the cover is closed then, the cover 20, being slightly larger than the access opening 16*a* in the top wall 15 between the grooves 16*h*, 16*h*, the depending cover walls 25, 25 will fit along the innermost walls 16*i* of the grooves 16*h* with the peripheral lip 23 resting on the bottoms of those grooves so as to further facilitate the substantially airtight seal.

Finally, it will be noted that front wall 13 of main body 10a has a depressed area 13*a* and, with reference to FIG. 1 of the drawings, for example, it will be seen that this underlies the forward edge of the peripheral lip 23 when the cover 20 is closed. This facilitates lifting of the cover 20 wherein the user may simply insert a finger or thumb in this depressed area 13*a* and engage the bottom of the peripheral lip 23 immediately adjacent latching means 24 to open the cover 20 to provide access to the interior of the dispenser 10.

Turning then to FIGS. 6 through 9 for a description of the base 40 and its relationship to the main body 10*a*, it will be noted that a locking arrangement is described and disclosed and that that locking arrangement is somewhat similar to the locking arrangement illustrated in Borst U.S. Pat. No. 4,986, 438. To that end, the base 40 is hinged to the front wall 13 of the main body 10*a* by the hinge 41 which is integral therewith. No detailed description of this hinge arrangement will be undertaken herein in view of the disclosure of the aforementioned Borst '438 patent.

A locking tab 50 is also disclosed in FIGS. 6 through 9 of the drawings, and this locking tab is somewhat similar to that of the one shown in the Borst '438 patent. That is, it is hinged to the body as at 51 and has an engagement projection 52 which fits between a peripheral wall 42*a* of the base 40 and what has been called a rim wall 42 thereof. A snug engagement between the projection 52 and those two walls will, as can be seen in FIG. 8 of the drawings, result in a relatively firm engagement between the base 40 and the main body 10*a*. It will further be noted that the base 40 has a concave central portion 40*a* which generally is dimensioned complementally to the convex portions 15*a*, 15*a* of the top wall and the convex portion of the cover 20 so that resting the base 40 of one such dispenser on the top of another will result in nesting thereof.

Returning to the locking mechanism, it will be noted that the projecting flange 53 of the locking tab is provided with ribbed areas 53*a* to facilitate grasping thereof for unlocking to open the base 40 relative to the main body 10*a* to replenish the supply of material therein. It will also be noted that recessed areas 43, 43 are provided in the base 40 with these recessed areas being disposed so as to underlie the flange 53 when the base 40 is in the closed and locked position. This further facilitates opening of the base 40 in that it enables the user to insert a finger or fingers in the depressed areas 43, 43 beneath the flange 53 to flip it or lift it out of engagement with the base 40 as a preliminary step in opening the dispenser. Furthermore, the flange 53 presents an indicia receiving surface **53*b* which is visible when the base is in the locked position. This permits the application of the indicia 53*c*** which generally would be instructional in nature.

It will also be noted that the base 40 itself presents an indicia receiving surface 45 (See FIG. 6) so that after the locking tab is disengaged further instructional indicia placed thereon will further assist the user.

Figure 7:
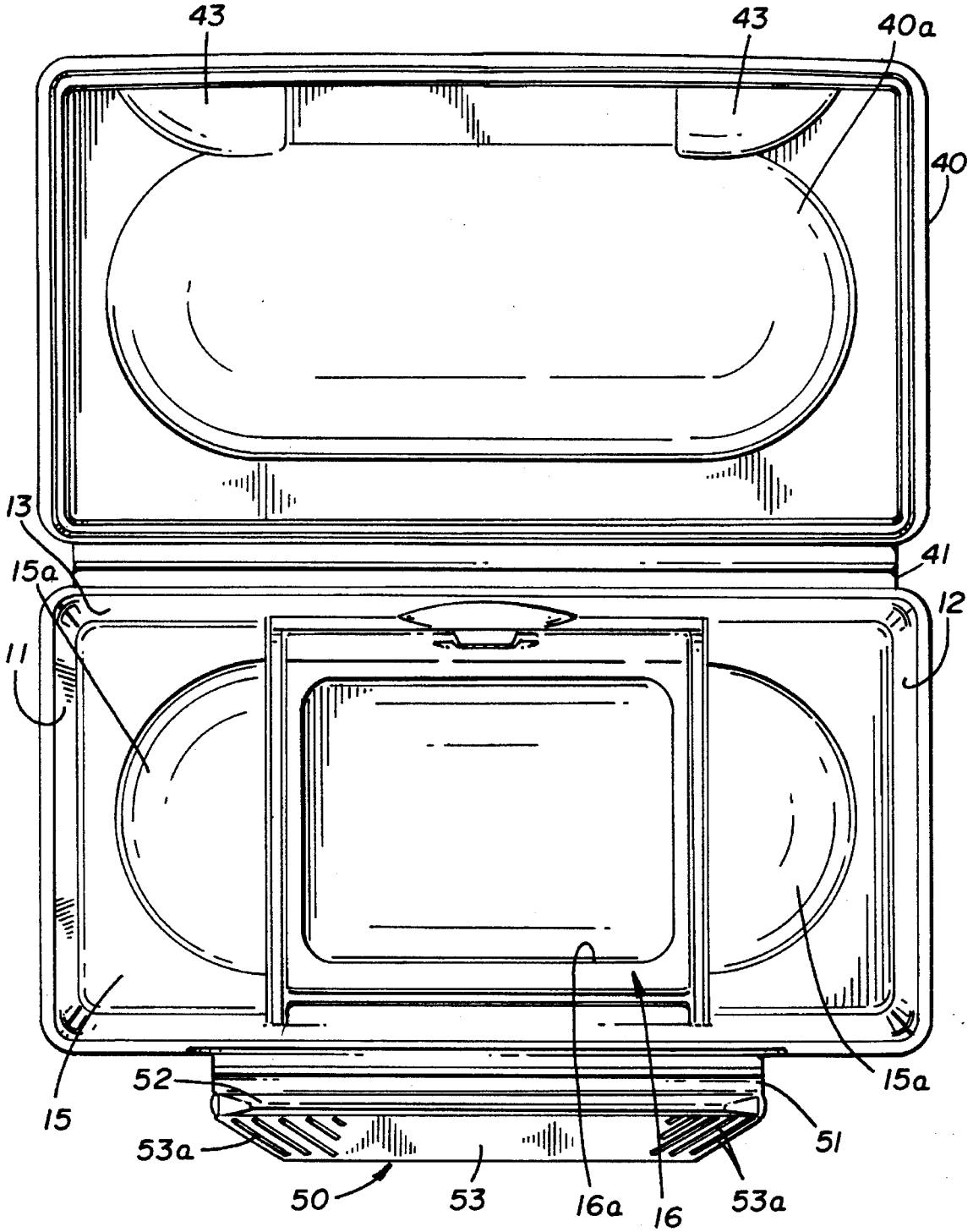
FIG. 7 is a plan view of the improved dispenser showing the base in the fully open condition.

In use or operation of the improved dispenser it will be noted that it is first necessary to unlock and open the base 40 and place the dispenser in the condition shown in FIG. 7 of the drawings. It is then possible to simply insert a pouch, box or other type of container containing the pre-moistened towelettes or other products into the interior cavity formed in the main body **10*a*. Presumably such a container would have a tear-off or otherwise openable top surface which would be in registry with the opening 16*a* in the recessed area 16 of the top wall 15. The base 40 can then be closed and locked and the dispenser will be in condition for shipment, storage or idle use. When it is desired to extract one of the products from the interior chamber it is simply necessary to engage the underside of the peripheral lip 23 and flip the cover 20 to the open position whereupon access to the contents can be had through the access opening 16*a***.

While a full and complete description of the invention has been set forth in accordance with the dictates of the patent statutes, it should be understood that modifications can be resorted to without departing from the spirit hereof or the scope of the appended claims.

What is claimed is:

1. A reclosable container, comprising:

a) a body including opposed end walls, opposed front and rear walls and a top wall to form an interior chamber;

b) said top wall having an access opening located therein;

c) a cover hingedly connected to said body and removable between covering and uncovering relationship with said opening;

d) a base, hingedly connected to said front wall for selectively opening and closing off said interior chamber;

e) first locking means for securing said cover to said body in covering relationship thereto and carried by said body and said cover;

f) second locking means carried by said base and said rear wall for securing said base in a position closing off said interior chamber;

g) said base having a concave surface area; and h) said top wall and said cover having convex surface areas whereby adjacent containers may be nested with respect to each other.

2. The reclosable container of claim 1 wherein said cover includes front and rear edges; said rear edge being hingedly connected to said rear wall; said first locking means include a locking projection depending from said cover adjacent said front edge; and said top wall of said body having a complemental depression for releasable receipt of said locking projection.

3. The reclosable container of claim 2 wherein a lip extends from said front edge of said cover.

4. The reclosable container of claim 1 wherein said front wall of said body has a concave recessed area disposed adjacent said recess in said top wall and beneath said first locking means when said cover is in covering relationship with said body.

5. The reclosable container of claim 1 wherein said top wall of said body has a recessed area; and said access opening is disposed in said recessed area.

6. The reclosable container of claim 5 wherein said recessed area includes a ledge surrounding said access opening and lying in a plane beneath the plane of said top wall.

7. The reclosable container of claim 6 wherein a hinge receiving shelf is disposed on said ledge adjacent the intersection of said rear and top walls; and said cover is dimensioned to substantially span the distance between said rib and said front wall when said cover is in covering relationship with said body.

8. The reclosable container of claim 7 wherein a substrate is attached to said rear wall of said body, said shelf and said cover to hingedly attach said cover to said body.

9. The reclosable container of claim 1 wherein said second locking means include a locking tab hinged to said rear wall of said body; said base has upwardly extending sidewalls and a rim wall spaced from said sidewalls whereby a portion of said locking tab may fit between said sidewalls and said rib wall; and said base has finger receiving depressions disposed so as to underlie said locking tab when said base is in locked condition.

10. The reclosable container of claim 9 wherein said locking tab has an indicia receiving surface disposed so as to be visible when said locking tab is engaged between said sidewall and said rim wall of said base.

11. The reclosable container of claim 9 or claim 10 wherein gripping means are disposed on said locking tab.

12. The reclosable container of claim 9 or claim 10 wherein said base has an indicia receiving surface that is covered when said locking tab is engaged between said sidewall and said rim wall of said base and visible when said locking tab is disengaged therefrom and rotated about its point of hinged connection with said rear wall of said body.

* * * * *